US005103618A

United States Patent [19]

Garwood

[11] Patent Number: 5,103,618

[45] Date of Patent: Apr. 14, 1992

[54] PACKAGING

[75] Inventor: Anthony J. M. Garwood, Knoxfield, Australia

[73] Assignee: Seawell Corporation N.V., Curacao, Netherlands Antilles

[21] Appl. No.: 488,664

[22] Filed: Feb. 28, 1990

Related U.S. Application Data

[63] Continuation of Ser. No. 328,125, Feb. 3, 1989, abandoned.

[30] Foreign Application Priority Data

Aug. 4, 1986 [AU] Australia ..... PH 7274

[51] Int. Cl.[5] ..... B65B 5/10; B65B 31/02; B65B 11/52

[52] U.S. Cl. ..... 53/433; 53/434; 53/449; 53/453

[58] Field of Search ..... 53/427, 432, 433, 434, 53/449, 453, 509, 373; 426/124, 129, 415, 418

[56] References Cited

U.S. PATENT DOCUMENTS

| | | |
|---|---|---|
| 2,865,499 | 12/1958 | Brogren . |
| 3,038,593 | 6/1962 | Root . |
| 3,116,153 | 12/1963 | Seiferth et al. . |
| 3,226,236 | 12/1965 | Weller . |
| 3,363,395 | 1/1968 | King . |
| 3,467,244 | 9/1969 | Mahaffy et al. . |
| 3,481,100 | 12/1969 | Bergstrom . |
| 3,490,576 | 1/1970 | Alessi et al. . |
| 3,514,029 | 5/1970 | Powell . |
| 3,545,163 | 10/1970 | Mahaffy et al. . |
| 3,574,642 | 4/1971 | Weinke . |
| 3,624,787 | 11/1971 | Newman . |
| 3,679,093 | 7/1972 | Chang . |
| 3,681,092 | 8/1972 | Titchenal . |
| 3,688,822 | 8/1972 | Wolfelsperger . |
| 3,695,900 | 10/1972 | Young . |
| 3,750,362 | 8/1973 | Kishpaugh . |
| 3,792,181 | 2/1974 | Mahaffy et al. . |
| 3,843,806 | 10/1974 | Kishpaugh et al. . |
| 3,851,441 | 12/1974 | Marchard . |

(List continued on next page.)

FOREIGN PATENT DOCUMENTS

| | | |
|---|---|---|
| 26918/67 | 9/1967 | Australia . |
| 18600/70 | 8/1970 | Australia . |
| 1153953 | 9/1983 | Canada . |
| 0116394 | 8/1984 | European Pat. Off. . |
| 1939216 | 8/1969 | Fed. Rep. of Germany . |
| 2550388.2 | 11/1975 | Fed. Rep. of Germany . |
| 2837127 | 3/1979 | Fed. Rep. of Germany . |
| 3114508 | 11/1982 | Fed. Rep. of Germany . |
| 2073269 | 12/1969 | France . |
| 2165761 | 12/1971 | France . |
| 1199998 | 7/1970 | United Kingdom . |
| 1206023 | 9/1970 | United Kingdom . |
| 1378140 | 9/1970 | United Kingdom . |
| 1286917 | 8/1972 | United Kingdom . |
| 1392580 | 4/1975 | United Kingdom . |
| 2041318 | 9/1980 | United Kingdom . |

OTHER PUBLICATIONS

Def. Pub. U.S. Ser. No. 742,410, dated 04/22/69, Titchenal.

*Primary Examiner*—Horace M. Culver
*Attorney, Agent, or Firm*—Foley & Lardner

[57] ABSTRACT

A method of packaging goods including placing goods such as meat over a base, applying a flexible web of gas permeable skin wrapping plastics material over the base and the goods, evacuating air or gas from between the base and the skin wrapping so as to allow the skin wrapping to flexibly displace onto the goods and to at least partially skin pack said goods. A lid is then applied over the skin wrapping and spaced therefrom. A gas is provided in the space between the lid and the skin wrapping to enhance the keeping properties of the packaged goods by permeating the skin wrapping. The lid is sealed to the base so that the space is permanently retained, the skin wrapping is attached relative to the base. Following discoloration of the packaged goods over a period of time, a fresh gas is allowed to enter the package and contact the surface of the goods within the skin wrapping without removal of the skin wrapping, whereby the color of the goods is improved.

7 Claims, 6 Drawing Sheets

U.S. PATENT DOCUMENTS 3,903,309 9/1975 Mahaffy et al. .
3,972,155 8/1976 Mahaffy et al. .
4,055,672 10/1977 Hirsh et al. .
4,058,953 11/1977 Sanborn, Jr. et al. .
4,069,348 1/1978 Bush .
4,114,348 9/1978 Mahaffy et al. .
4,201,030 5/1980 Mahaffy et al. .
4,308,711 1/1982 Mahaffy et al. .
4,340,138 7/1982 Bernhardt .
4,349,999 9/1982 Mahaffy et al. .
4,411,122 10/1983 Cornish et al. .
4,424,659 1/1984 Perigo et al. .
4,454,945 6/1984 Jabrin et al. .
4,491,225 1/1985 Baillod .
4,517,206 5/1985 Murphy et al. .
4,543,770 10/1985 Walter .
4,574,174 3/1986 McGonigle .
4,581,764 4/1986 Plock et al. .
4,622,229 11/1986 Toshitsugu .
4,683,139 7/1987 Cheng .
4,685,274 8/1987 Garwood .

PACKAGING

This application is a continuation of application Ser. No. 07/328,125, filed Feb. 3, 1989 and now abandoned.

FIELD OF THE INVENTION

This invention relates to improved packaging and relates particularly, but not exclusively, to improved packaging for containing meat, fish and poultry or other food products or other products and relates to an improvement in the packaging disclosed in applicants co-pending Ser. No. 086,046, filed June 19, 1987, now U.S. Pat. No. 4,840,271.

BACKGROUND OF THE INVENTION

German offenlengungsschrift No. 2837127 to W. Van Oord and Co. B.V. discloses packaging of plastics material suitable for production in a packaging machine. The packaging comprises an outer pack and an inner pack in which goods such as meat can be packed. The outer pack serves as a protective casing for the inner pack. The inner pack is preferably evacuated of air and so that the inner pack material shapes to the contour of the goods, such as meats, which are within the inner pack, by reason of the external air pressure pushing the inner pack onto the meats. The inner pack may contain a gas which will enhance the keeping of the packaged goods. There is a space between the inner pack and the outer pack and this is filled with atmosphere. The shelf life of the packaged goods is limited.

British Patent Specification No. 1,392,580 to Standard Packaging Corp. discloses a similar type of packaging. This packaging comprises an outer plastics material base into which the goods, such as red meats, are placed. A composite lid is provided which seals the goods within the base. A desired gas can be provided within the package to enhance the keeping of the goods therein. The composite lid is such that it has two layers. The outermost layer can be peeled from the innermost layer to permit oxygen in the atmosphere to pass through the oxygen permeable inner layer and assist in restoring the red colour to the meat which may have been lost due to the storage time of the packaged goods. The inner layer therefore still provides a cover and a seal for preventing ingress of foreign material. The shelf life of the packaged goods is limited due to the limited volume of the desired gas which can be packaged within the package and which is used to assist the keeping qualities of the packaged goods.

British Patent Specification No. 1,199,998 to Unilever Ltd. discloses a similar type of packaging. Two distinctly different embodiments are disclosed.

(a) The first comprises packaging with a base into which desired goods, such as red meats, are inserted. A first film lid is placed over the goods to seal them within the base. A desired gas to enhance the keeping qualities of the packaged goods can be provided under the first film lid. A second film lid is placed over the first film lid and seals a desired gas under pressure between the first film lid and the second film lid. This desired gas may also be for enhancing the keeping qualities of the packaged goods. The first film lid is gas permeable. The second film lid is gas impermeable and the gas which is under the second film lid can therefore permeate through the first film lid to contact the packaged goods to enhance the keeping qualities thereof. Thus, the entire volume of gas in the package which equals the volume of the package minus the volume of the packaged goods, can be utilized for enhancing the keeping qualities of the packaged goods. This packaging has shortcomings owing to the fact that the packaged goods are not skin wrapped within the package and therefor this package is not readily acceptable for the attractive presentation of the goods.

(b) The second packaging comprises a total skin wrapping of the packaged goods but the skin packing materials are not adhered to the base or outer packaging. Hence the packaged goods can flop around within the package. This does not provide a package which is readily acceptable for the attractive presentation of the goods.

All of the above packaging has inherent problems with regard to cost of raw materials, cost of production, inability to be made easily in a single packaging machine, and undesirable appearance to the customer. Some of the above problems have been addressed in my U.S. Pat. No. 4,840,271 where the packaged goods are skin wrapped relative to the base of the packaging and wherein there is provided a lid over the packaging. The space between the lid and the skin wrapping contains a desired gas which can permeate through the skin wrapping material and thereby assist in the keeping qualities of the packaged goods.

STATEMENT OF THE INVENTION

The present invention has realized that there should be skin wrapping of the packaged goods, and where the goods are held relative to the outer package and where an outer lid covers the skin packaging. The space between the lid and the skin wrapping may contain a desired gas to enhance the keeping qualities of the packaged goods. The outer lid is such that it can be peeled off the packaging or it can be ruptured whereby oxygen from outside of the packaging can be caused to permeate the skin wrapping material or otherwise pass through the skin wrapping to contact the goods and assist the packaged goods, such as red meat being restored to the original colour. Thus, meat can be packaged for some considerable time even though the colour may change, and then before being placed on shelves for sale to the public, oxygen can be allowed to permeate to thereby substantially improve the colour for sale purposes.

For red meats it is particularly preferred that the gas which is external of the package and which is used to improve the colour be oxygen. It may be caused to contact the meat by passing through an opening made in the lid and by permeation through the skin wrap material.

Alternatively it may be caused to be passed directly to the red meat by passing through an opening made in the lid and the skin wrapping material. The opening can then be sealed.

Therefore according to a first broad aspect of the present invention there may be provided a method of packaging goods including:

(a) providing a base,
(b) providing skin wrapped goods over said base,
(c) applying a lid over said base,
(d) sealing said lid to said base with a desired gas between said lid and said base which will enhance the keeping properties of the packaged goods, and
(e) following discolouration of the packaged goods with time, allowing a gas which will improve the colour of the goods to contact the surface of the goods within the skin wrapping without removal of the skin wrapping.

In one embodiment step (e) is performed by peeling off the lid and allowing $O_2$ which will be in the atmosphere to selectively permeate through the skin wrapping. The packaging can then optionally be repacked in an outer package.

In another embodiment one or more apertures are punched through the lid and the skin wrapping so that $O_2$, which is in the atmosphere or in a gas environment in which the packaging is situated, can pass through the one or more apertures to directly contact the goods. The aperture can then be resealed.

BRIEF DESCRIPTION OF PREFERRED EMBODIMENTS

Figure 1:
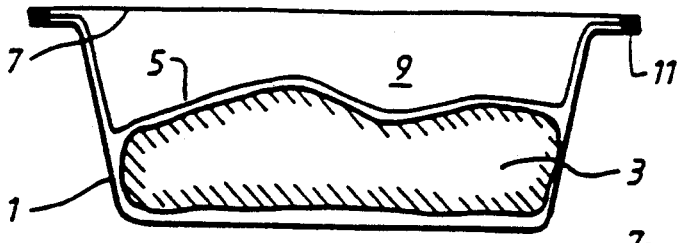
FIGS. 1 through 6 represent diagrammatical side views of six different types of packaging within the scope of the invention disclosed in my aforementioned earlier application Ser. No. 086,046.

Referring now to FIG. 1 there is shown packaging made of plastics materials. The packaging comprises a generally rectangular shaped base 1. The base 1 is preferably made by a thermo forming process as will be described later. Typically the base 1 is made from a plastics material which may be gas permeable or it may be a gas barrier material. Examples of gas permeable materials are a multi-layer web comprising one layer of P.V.C. and the other layer of P.E.. The P.V.C.. can have a thickness of about 400 microns whilst the thickness of the P.E. can be about 70 microns. Alternatively, the material may be a multi-layered web of P.V.C. with a heat sensitive coating which will enable bonding to other plastics components in the package. The P.V.C. can be of a thickness of 450 microns and the coating can be of a thickness of about 5 microns. When a gas barrier material is provided then it may be comprised of multi-layered web of P.V.C./P.V.D.C./P.E.. The overall thickness of the plastics material is preferably about 450 microns. Other suitable materials can be chosen if desired.

Goods 3 are provided in the base 1. The goods 3 are typically meat, fish or poultry although other types of goods such as foodstuffs can be packaged if desired. Typically the goods 3 have about the same shape and are of the same size as the bottom of the base 1.

A web of plastics material 5 is skin wrapped to the upper surface of the goods 3. The plastics material 5 is typically of polyethylene of 100 micron thickness. Alternatively, it may comprise a plasticized P.V.C. of 100 micron thickness which is preferably heat sealable to the base 1. It may be otherwise sealable to the base if desired. The above described web 5 is a gas permeable web. If a gas barrier web is required then it may comprise a multi-layered web of P.E./P.V.D.C/P.E. of about 100 micron thickness overall. Other suitable materials for the web can be used if desired.

A lid 7 is fitted to the top of the base 1 so as to provide a free space 9 between the web 5 and the lid 7. The lid 7 and the web 5 are sealed to the base 1 around the peripheral lip 11 of the base 1. Conveniently the sealing is by way of a heat sealing although other forms of sealing are envisaged. The free space 9 can contain air if desired and/or a suitable gas which will enhance the keeping of the packaged goods. Typically the volume of the free space 9 is arranged to be at least equal to the volume necessary to maintain the keeping of the packaged goods for several days. The gas which is provided in the free space 9 may conveniently be an inert gas or other gas which will enhance the keeping qualities of the goods 3.

The lid 7 is typically of 120 microns in thickness. If it is of a gas permeable material it may comprise a multi-layer of P.V.C./P.E.. Alternatively, it may comprise a multi-layer of P.V.C. with a heat sensitive coating such as an adhesive to effect sealing to the web 5 which is, in turn, sealed to the peripheral lip 11 of the base 1.

If lid material is to be a gas barrier, then it may comprise polyester/P.V.D.C./P.E. or other suitable materials.

Figure 2:
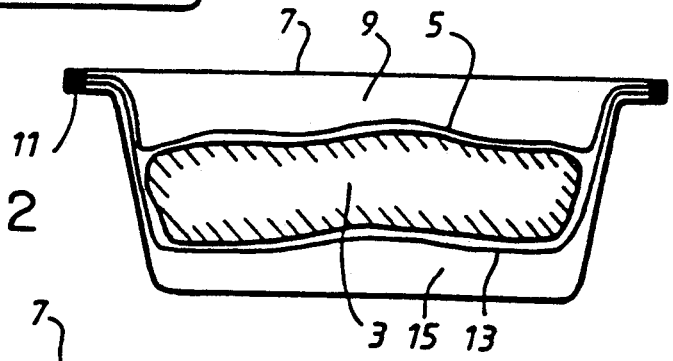

Referring now to FIG. 2 there is shown a construction very similar to that of FIG. 1 and accordingly like numerals have been given to the same components. In this construction, the goods 3 are received within a further web of plastics material 13. In this embodiment the goods 3 are completely skin wrapped around their external surface by the web of plastics material 5 and the further web of plastics material 13. It is noted that a further free space 15 is provided underneath the goods 3 below the further web of plastics material 13. This free space 15 may be filled with gas such as air and/or an inert gas to enhance the keeping of the packaged goods 3. This gas may be the same as or different to the gas in the free space 9.

Figure 3:
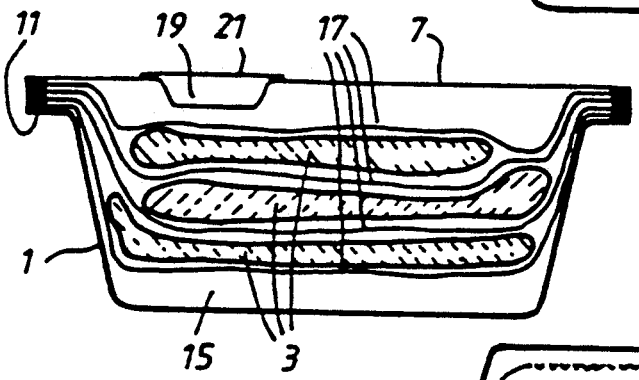

FIG. 3 shows an embodiment similar to that of FIG. 2 but wherein there are a plurality of layers of packaged goods 3. In this embodiment each of the layers of goods 3 is individually skin wrapped by its own individual web of plastics material designated generally by numeral 17. Each of the webs of plastics material 17 may comprise the same materials as that proposed for the webs 5 and 13. In this embodiment the lid 7 comprises a pouch 9 into which condiments can be provided. Typically the condiments can be sauces for the packaged goods. The pouch 9 can have a removable cover 21 which may conveniently comprise a web of paper or the like with a suitable adhesive medium on the underside to bond to the lid material around the periphery of the pouch 19.

Figure 4:
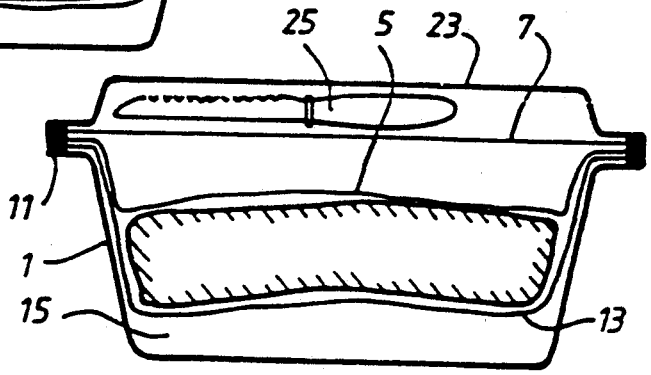

FIG. 4 shows an embodiment similar to that of FIG. 2 but wherein there is additionally provided an upper lid 23 which contains eating implements such as a knife, fork or spoon 25.

Figure 5:
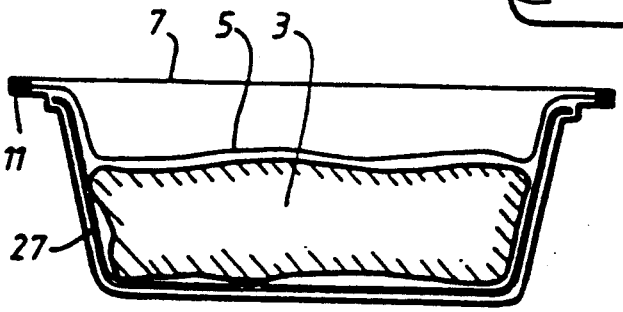

FIG. 5 shows an embodiment similar to that of FIG. 1 but wherein there is additionally provided an ovenable tray 27. The ovenable tray 27 may conveniently be comprised of metal foil or of a plastics material such as C.P.E.T. of about 400 microns in thickness. This material C.P.E.T. is known for its dual ovenable qualities and is used in the food packaging industry.

Figure 6:
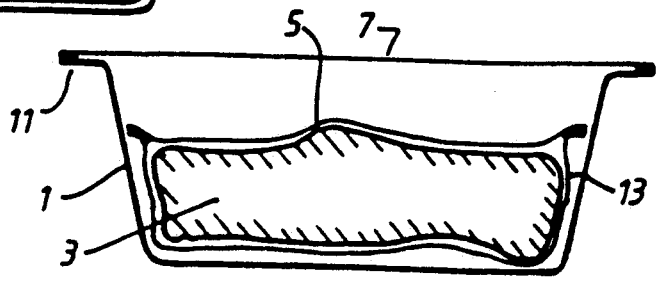

FIG. 6 shows an embodiment where the goods 3 are skin wrapped by webs 5 and 13 so that the goods 3 are maintained as a separate identity relative to the base 1. In other words the webs of plastics material 5 and 13 are only welded to each other and not to the peripheral lip 11 of the base 1.

In the case of embodiments shown in FIGS. 1 through 4 and 6 the base may be of a semi rigid construction whilst the webs 5, 13 and 17 are relatively flexible. In the case of the embodiments shown in FIG. 4, the lid 23 is of a semi rigid construction.

If desired punched openings may be made through the various webs 5, 13 and 17 around the peripheral sides of the goods 3 in such a manner that the goods 3 are still sealed with the webs but so that there is an opening extending therethrough. This will allow the gas which is in the free spaces 9 and 15 to freely circulate around the goods 3.

Figure 7:
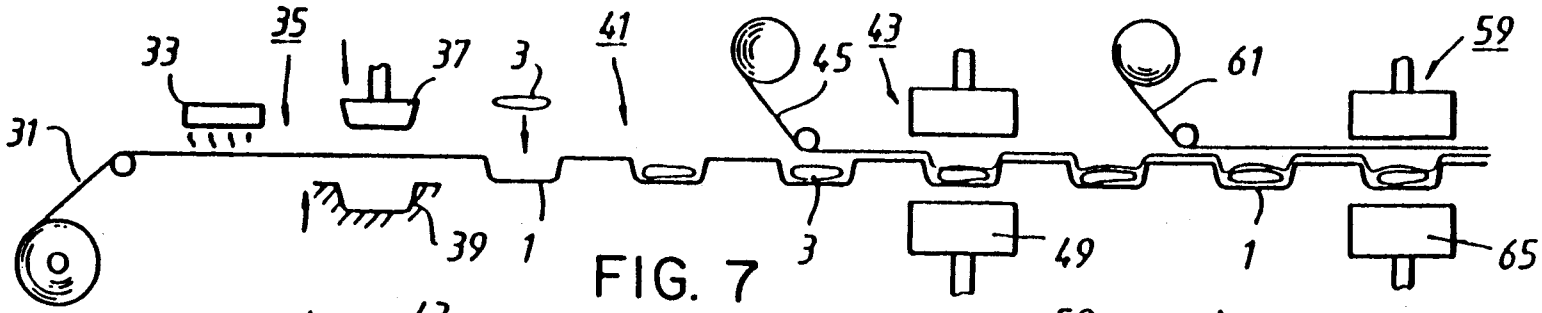
FIG. 7 is a schematic side view of one preferred machine used for performing a preferred method of the invention disclosed in the aforementioned application Ser. No. 086,046.
Figure 8:
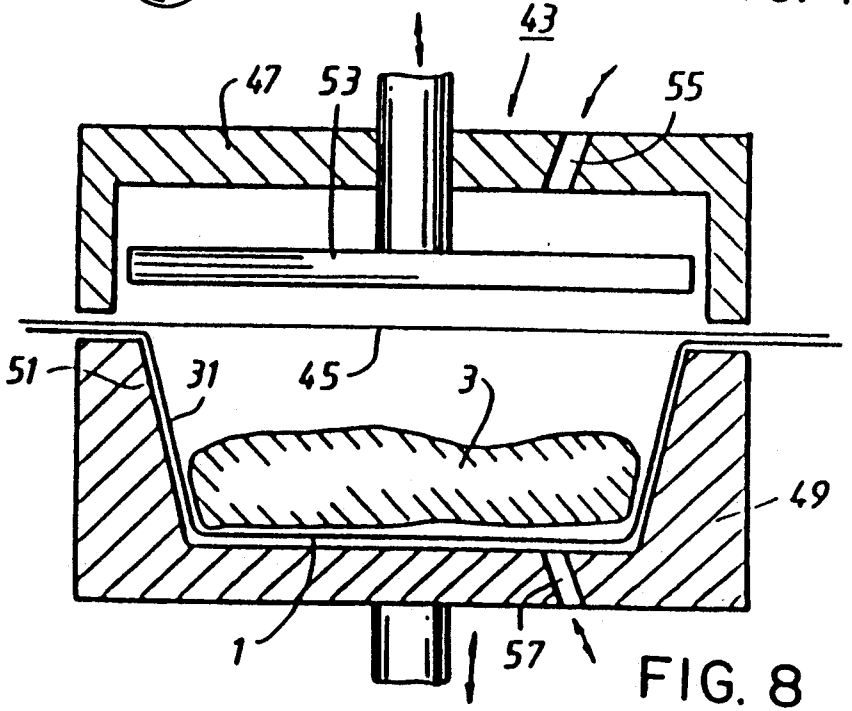
FIG. 8 is a close-up side cross-sectional view of a station of a machine where the web of plastics material is skin wrapped over the goods in the base, also disclosed in Application No. 086,046.
Figure 11:
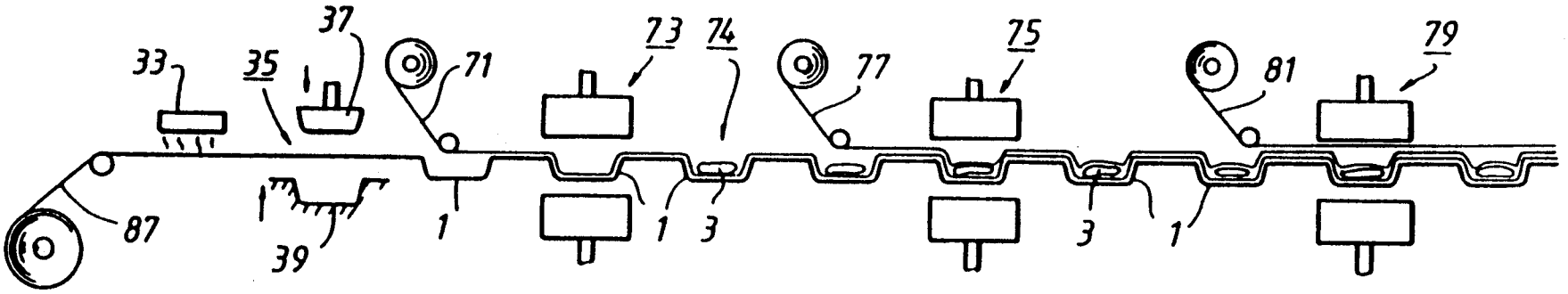
FIG. 11 is a schematic side view of a preferred machine for making the package shown in FIGS. 10, disclosed in Ser. No. 086,046.
Figure 12:
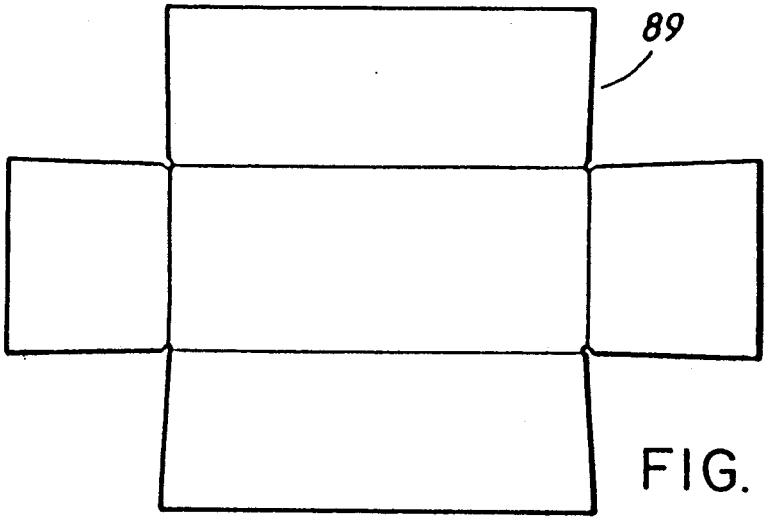
FIG. 12 is a plan view of a preferred insert for use in the package produced by the machine of FIG. 10, disclosed in Ser. No. 086,046.
Figure 10:
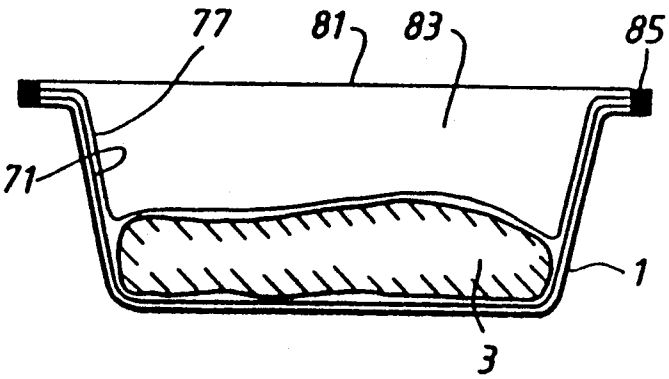
FIG. 10 is a diagrammatical side view of a different type of packaging disclosed in Ser. No. 086,046.

Referring now to FIG. 7 there is shown a side view in a schematic form of a preferred packaging machine which performs a preferred packaging method. The machine is arranged so that a web of plastics material 31 can pass underneath a heating member 33, be heated and then pass to a thermo forming station 35 where trays 1 can be produced by inserting a male die member 37 into a female die cavity 39. The so formed bases 1 then move to a goods loading station 41. The bases 1 are loaded with the goods such as food and then pass into a skin wrapping station 43. At the skin wrapping station 43, a web of plastics material 45 is arranged to run parallel with the web 31. FIG. 8 shows a close up view of the skin wrapping station 43. Here there is an upper chamber 47 and a lower chamber 49. The lower chamber 49 has a cavity 51 into which the bases 1 are received. The upper chamber 47 contains a heated member 53 which is used to heat the web 45 to a thermoformable temperature. The upper chamber 47 and the lower chamber 49 are then closed and air is evacuated via gas passageways 55 and 57. The web 45 is maintained separate to the top of the base 1 during this evacuation process. When the air has been evacuated, the heated member 53 is moved downwardly to heat seal the web 45 around the periphery of the base 1 to the lip 11. Air is then reintroduced through passageway 55, at least, and this, in turn, causes the web 15 to skin wrap to the top of the goods 3 in the base 1. The reason that it skin wraps to the goods 3 is that there is substantially no air between the web 45 and the base 1. Accordingly, when the air is introduced through the passageway 55 the flexible web 45 skin wraps onto the upper surface of the goods 3.

Figure 9:
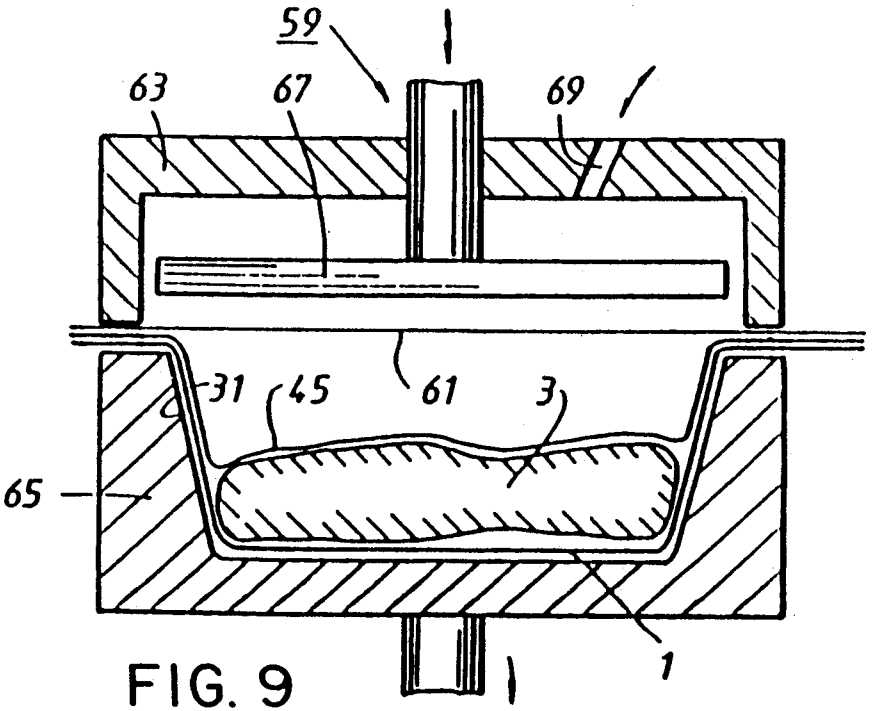
FIG. 9 is a view similar to that of FIG. 8 but showing a gas flushing station disclosed in Ser. No. 086,046.

The bases 1 then move to a lid sealing station 59. At this station, a web of plastics material 61 is provided over the top of the base 1, over the web 45. FIG. 9 shows a detailed cross-sectional view of the lid sealing station 59. The lid sealing station 59 comprises an upper chamber 63 and a lower chamber 65. It also includes a heated platen 67. The platen 67 is conveniently heated only around the lip 11 region of the base 1. In use, the upper chamber 63 and the lower chamber 65 are closed together and air is evacuated through the air passageway 69. If desired a desired flushing gas can then be admitted into the closed upper chamber 63 and lower chamber 65 so as to provide a desired gas between the lid and the base, i.e. between the web 61 and the base 1. The platen 67 can then be lowered to heat seal the lid to the lip 11 of the base 1.

It should be appreciated that when the lid 7 is sealed to the base 1, there will be provided a free space, as shown by 9 in FIG. 1, and the free space contains a desired flushing gas.

The package is then removed from the lid sealing station 59 and separated from the web 31 by suitable means.

If desired, the skin wrapping station can also include the step of admitting a desired flushing gas through the gas passageways 55 or 57 immediately prior to the sealing of the web 45 to the lip 11 of the base 1. This will provide a desired flushing gas within the space between the base 1 and the web 45.

It can be appreciated that by adding various stations to the apparatus shown in FIG. 6, any one of the embodiments shown in FIGS. 1 through 6 can be produced. For example, to produce the embodiment of FIG. 2 a further web of plastics material 13 need be provided prior to loading of the goods 3 into the base 1. The web 13 and 5 can be simultaneously welded to the peripheral lip 11 by a single heated platen. In producing the embodiment of FIG. 3 each of the webs 17 and goods 3 can be individually layered and then heat sealed to the peripheral lip 11. By appropriate additions, as explained, any one of the embodiments of FIGS. 1 through 6 can be produced. Such production is relatively economic and will yield a high throughput of packages.

By packaging goods such as fish it is possible to retain the usual drip liquid with the fish but to allow for controlled atmosphere or gas to permeate through the skin webs. This, in turn, will allow for freezing of the contents without the growth of ice crystals or the like as is normal in frozen fish packaging. The appearance of the package is particularly enhanced by the double glazing effect provided by the lid 7 and the web 5 and 13 or webs 17. In the embodiments of FIGS. 2, 3 and 4 the contents or goods 3 are effectively within an inner pouch If desired the goods 3 can be frozen in a separately filled and sealed frozen pouch in a jig of the same size as the semi rigid ovenable tray 27—see FIG. 5. In this case the goods 3 can be maintained in a separate pouch of plastics material if desired prior to the freezing.

All the plastics material or other materials from which the packaging is made may individually or collectively restrict and/or inhibit or control or allow selected atmosphere or gases to flow into or out of the package.

All of the above description corresponds generally with the description in the aforementioned Ser. No. 086,046.

DETAILED DESCRIPTION OF PREFERRED EMBODIMENTS

Figure 13:
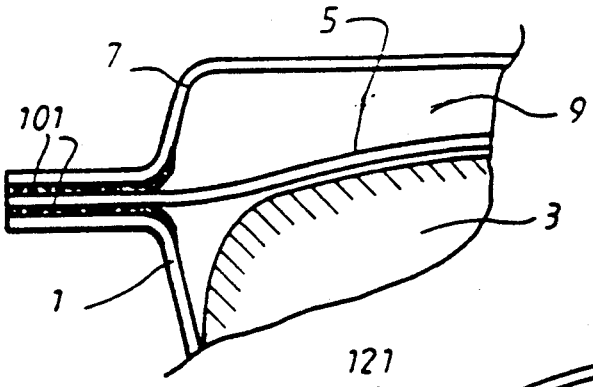
FIG. 13 is a close-up sectional view of a side edge of a preferred packaging in accordance with the present invention.
Figure 14:
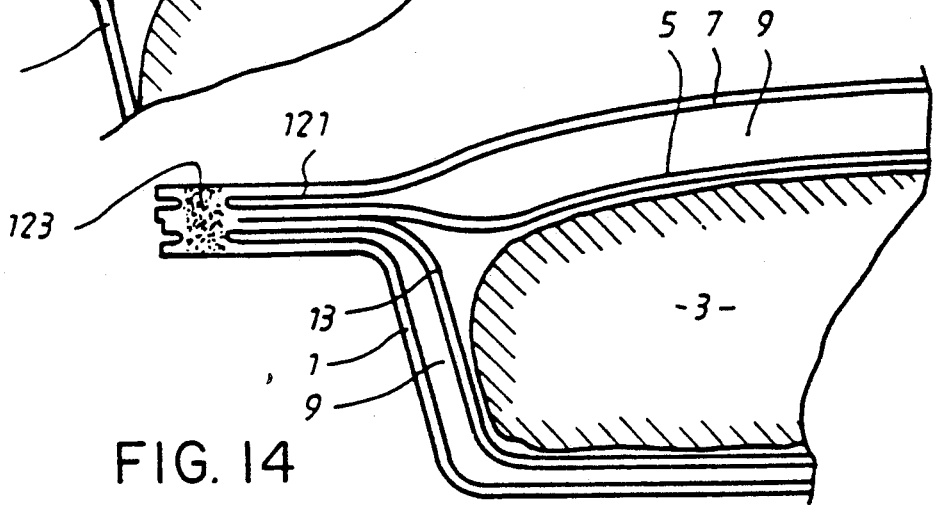
FIG. 14 is a close-up sectional view of a side edge of a package in accordance with a different embodiment of the present invention.

In the embodiment of the present invention shown in FIG. 13 the lid 7 is of semi-rigid material and may conveniently comprise a multi-layer web with 100 micron thickness of P.V.C. on the upper outer surface and a 30 micron thickness of polyethylene on the under or inner surfaces. The web 5 is typically a flexible web of 20 micron thickness of flexible polyethylene. The web 5 is permeable by gases which are inert to the packaged goods such as $O_2$, $CO_2$ and $N_2$ or mixtures thereof which may be in the space 9. The base 1 is of multi-layer web material with 400 micron thickness P.V.C. on the outer surfaces and 70 micron thickness polyethylene on the inner surfaces. The lid 7 is sealed to the base 1 around the peripheral edges on a lip or flange and a seal 101 is provided to the web 5. This is caused by partial melting of the polyethylene materials on the lid 7, the flexible web 5 and the base 1. Such a seal 101 is peelable from the base 1 while leaving the flexible web 5 intact and sealed to the base 1. The goods are thus packaged in an environment where atmospheric air or gas cannot directly touch the goods but where certain atmospheric gas or gases can pass into or out of the packaging. The packaging is such that the goods will have a relatively long shelf life compared to the same goods not packaged in such packaging. Thus, after prolonged shelf life where there may be discolouring of the contents 3 such as browning of red meats, the lid 7 can be peeled from the base 1 whereupon $O_2$, $CO_2$ or $N_2$ or other suitable gases can also permeate through the web 5 and thereby assist in restoration of the colour of the products 3. Typically, the package can have a small diagonal cut across one corner of the peripheral lip which will enhance the peeling of the lid 7 from the base 1. This cut can be provided during manufacture of the package by providing a score line or the like in the under surface of the peripheral lip of the base 1. Thus, by engaging with that portion of the lip outwardly of the score line, the lid 7 can be easily separated.

Referring now to FIGS. 14 through 17 there is shown packaging of a different embodiment of the present invention. Here it can be seen that the packaging has a considerable width peripheral flange or lip 121. This peripheral lip 121 may be provided at one or more side edges. It can be seen that the lid 7 is sealed to the skin wrap 5 and 13, all being sealed together as shown by numeral 123. It is noted that the sealing 123 is near the outer extremity of the peripheral lip 121. The packaging is therefore very similar to the packaging of embodiments 1 through 5 as disclosed previously. The lid 7 may comprise a multi-layer web of plastics material having 100 micron thickness P.V.C. as the upper layer and a 15 micron thickness of P.E.T. as the lower layer. The webs of plastic material 5 and 13 can be of 20 micron thickness plasticized flexible P.V.C. or P.E.. The base 1 may be of a multi-layer of 400 micron thickness P.V.C. as the bottom layer and 15 micron thickness P.E.T. as the upper layer. Thus, the contacting surfaces of the various webs 7, 5, 13 and 1 are of materials which can be heat bonded to each other to effect sealing of the packaging. If desired the web 13 can be bonded as by heat sealing to the base 1 at one or more locations near the lower most portion of the base 1. This will cause the web 13 to conform generally to the shape of the base 1 prior to insertion of goods 3 such as red meats. Desired gas or gases for enhancing the keeping of the goods may be provided in the space(s) 9. The webs 5 and 13 are such that certain gases may pass therethrough, either or both into or out of the skin packaging. The goods are thus packaged in an environment where atmospheric air or gas cannot directly touch the goods but where certain atmospheric gas or gases can pass into or out of the packaging. The packaging is such that the goods will have a relatively long shelf life compared to the same goods not packaged in such packaging.

Figure 15:
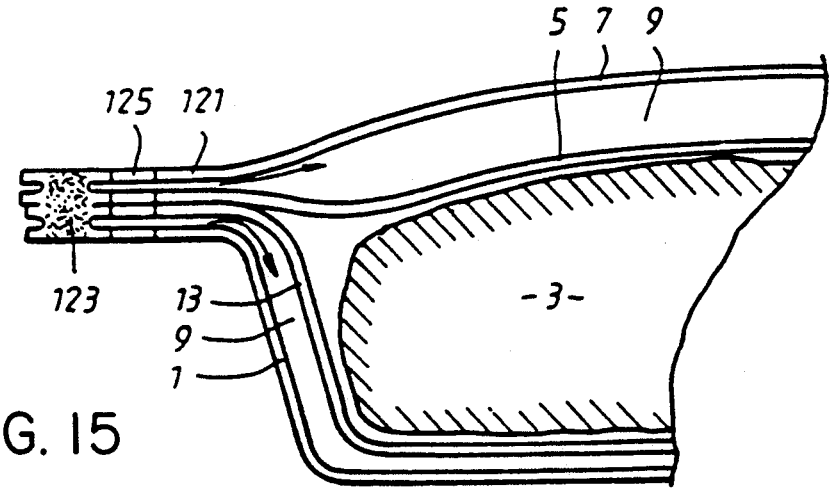
FIGS. 15 and 16 are views similar to that of FIG. 14 showing different stages during processing of the packaging shown in FIG. 14.

Considering FIG. 15, it can be seen that an aperture 125 is punched completely through the peripheral lip 121. This aperture allows the gases in space(s) 9 above web 5 and below web 13 to escape. It also allows desired gas such as atmospheric gases which contain $O_2$ to be introduced to replace the gases which exhaust and therefore such desired gases can pass through the webs 5 and 13 and assist in the goods 3 returning to the original colour.

If desired, suitable gases can be forcibly introduced through the aperture 125 by placing the package within a chamber where firstly, gases are exhausted through the aperture 125, and then, desired gas or gases can be placed within the chamber whereby such gas or gases can then be introduced within the package through the aperture 125. One or more apertures 125 may be provided on the peripheral lip 121 if desired. Additionally, the peripheral lip 121 may extend completely around the package and accordingly a multitude of apertures 125 can be provided to assist in the extraction of the suitable gases 9 and then the subsequent introduction of desired gas or gases.

Figure 16:
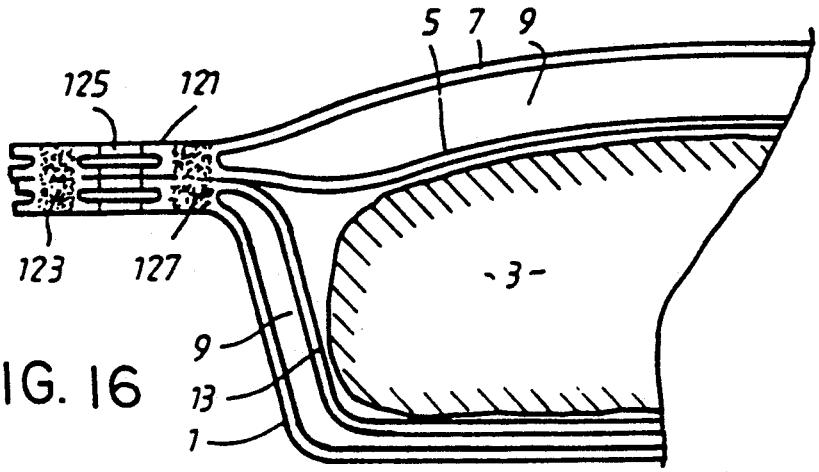

Referring now to FIG. 16 it can be seen that a second seal 127 is provided at the inner most side of the peripheral lip 121 thereby sealing the package relative to the aperture 125. Thus the desired gas can be maintained within the package above web 5 and below web 13.

Figures 17, 18:
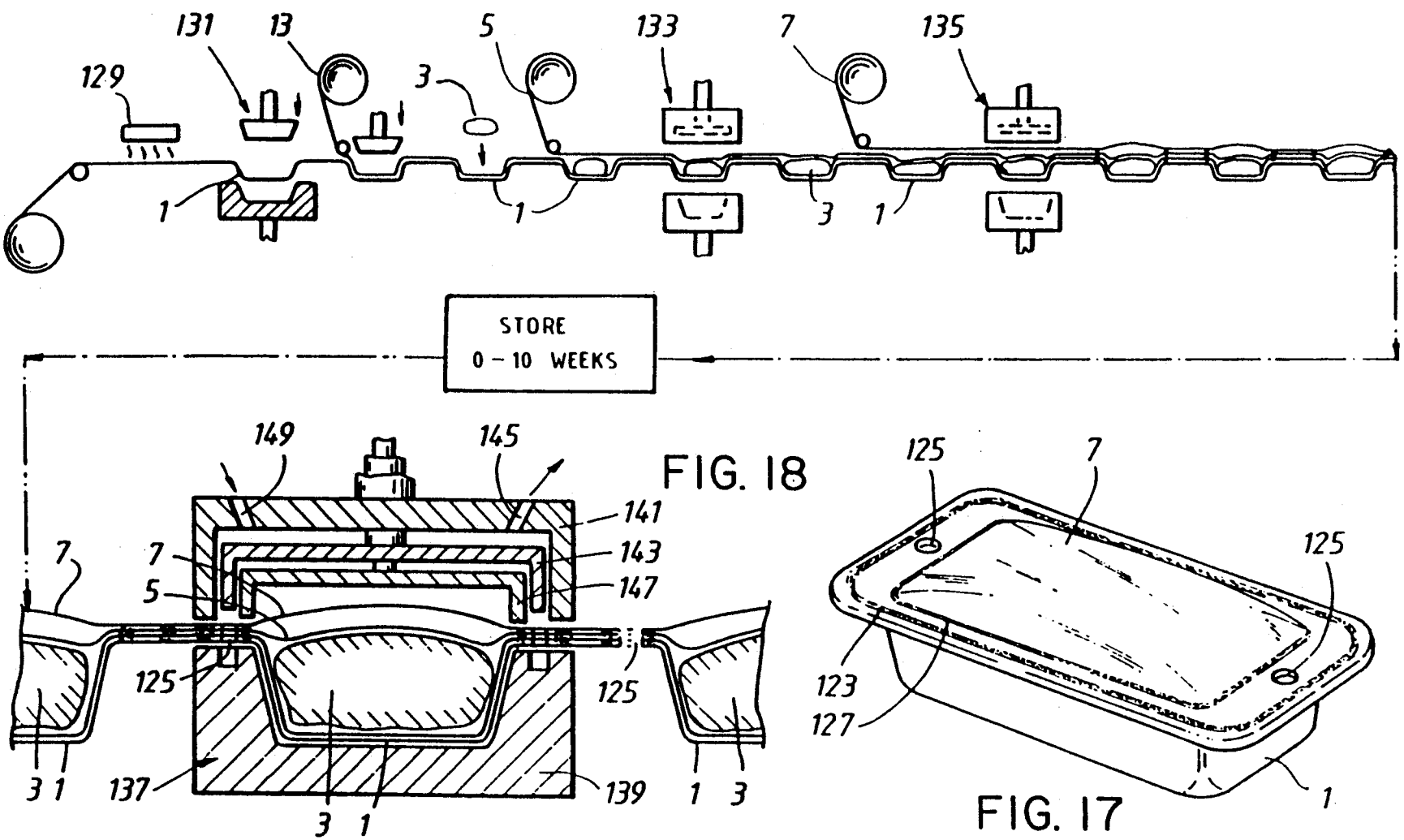
FIG. 17 is a perspective view of the packaging envisaged in FIGS. 14 through 16.
FIG. 18 is a diagrammatic representation of preferred packaging apparatus and preferred method for producing the packaging shown in FIGS. 14 and 17.

FIG. 17 shows a top perspective view of the packaging and it can be seen that the seal 123 is on a peripherally outer most edge of peripheral lip 121 while seal 127 is on an inner edge of the peripheral lip 121. If the aperture 125 comprises a hole then the packaging can be suspended from a hook or the like at a display stand.

The introduction of desired gas or gases such as $O_2$ will permit red meat which is discoloured to dark brown as a result of depletion of oxygen from the red blood therein to assume a colour expected by a purchaser, i.e. to substantially resume to the original red colour as such gas will then be able to contact the surface of the red meat.

Referring now to FIG. 18 there is shown a diagrammatic representation of processing of the packaging shown in FIGS. 14 through 17. Here it can be seen that web 1 passes underneath a heater 129 and then passes into a thermo forming station 131 where the base 1 is formed. Web 13 is then introduced over base 1 and may be spot welded to the bottom of base 1. Goods 3 are then introduced into the base 1. Web 5 is then introduced over base 1 and advanced to a skin wrapping station 133. Web 7 is then introduced over base 1 and passes to a gas flushing station 135. The lid 7 is sealed to the base 1 at the gas flushing station 135 where desired gas or gases are provided in the spaces 9. The packages may be left intact in a continuous web and stored from say 0 to 10 weeks for red meat. It is anticipated that the meat will discolour to dark brown during this period. Accordingly, the packages are then introduced to a desired gas insert station 137. The gas insertion station 137 has a lower cavity 139 and upper cavity 141. Cavities 139 and 141 are relatively movable to enclose the packaging. When the cavities 139 and 141 are closed, then a punch 143 is lowered to provide the apertures 125 in the packaging. The gases which are then within the package 1 can be exhausted through opening 145. A heated sealing member 147 is provided within the upper cavity 141. After desired gases are introduced through opening 149 and pass within the package 1 through the apertures 125 then the heated sealing member 147 can be lowered to seal the desired gases within the package. The packaging can then be placed on display stands for sale.

Figure 19:
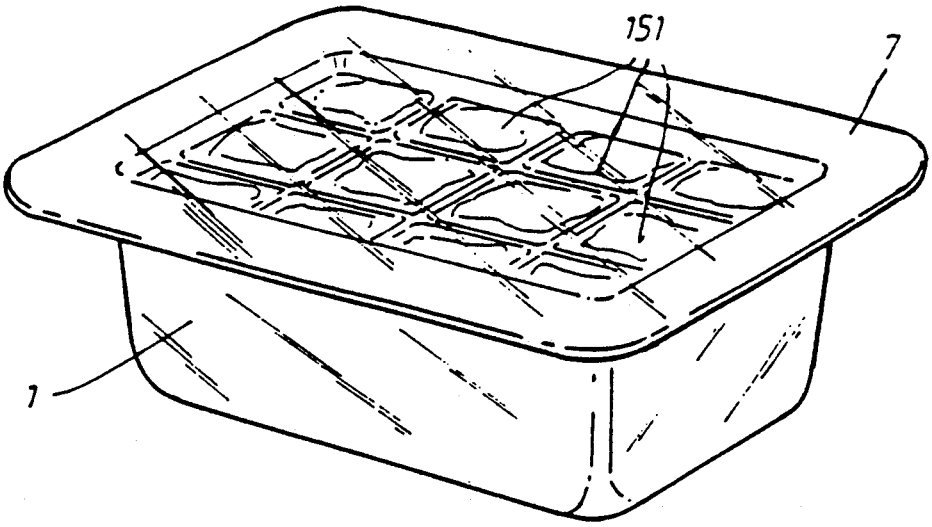
FIGS. 19–21 show alternative embodiments of packages in accordance with the instant invention.
Figure 20:
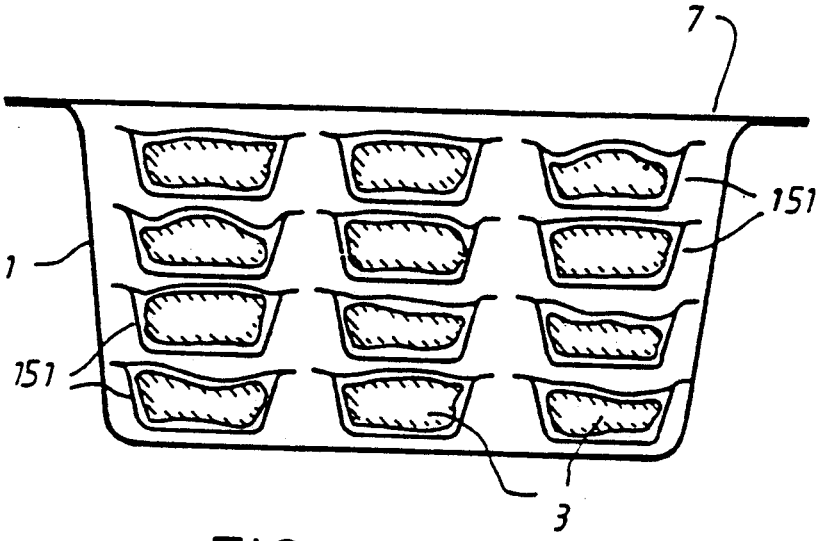
Figure 21:
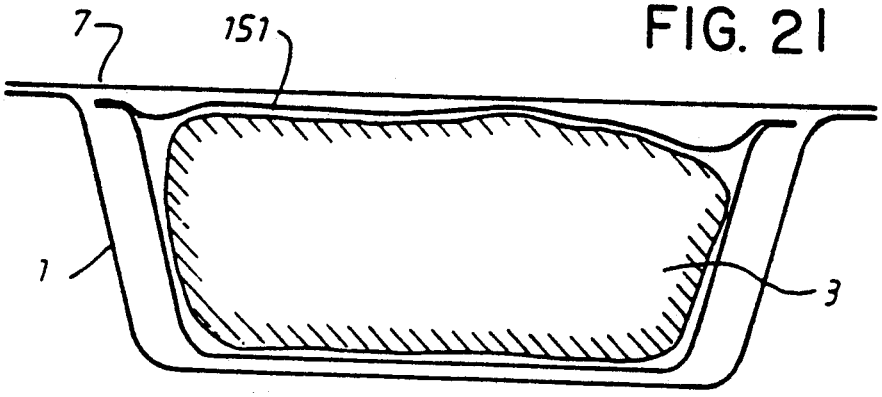

Referring now to FIGS. 19 through 21 there is shown a top perspective view of a large container having a base 1 and a peripheral lip 7 with a number of smaller skin-wrapped packages 151 therein. The skin wrap material can be of the same type previously disclosed so that certain gases can selectively pass into or out of the packages 151. The container can be filled with a suitable gas of the type hereinbefore mentioned for enhancing the keeping of the packaged goods. FIG. 20 shows a side cross-sectional view of the package shown in FIG. 19.

It is anticipated that if the goods 3 are red meat then they will discolour to dark brown after a period of time. Accordingly, the packaging can be opened thereby allowing the suitable gases to be expelled. The individual skin-wrapped packages 151 will then be subject to desired gases permeating such as $O_2$, which will assist in the goods 3 resuming the desired colour. If desired, the individual skin-wrapped packages 151 can then be repackaged in respective further outer packages comprising base 1 and lid 7 which can be made from the aforementioned materials from which those bases 1 and lids 7 have been made as set out previously. A desired gas can be provided within that package to assist in the colour reforming of the goods 3. This construction is shown in FIG. 21.

A suitable sealing station for use in any of the embodiments herein is disclosed in applicant's earlier U.S. Pat. No. 4,685,274, to which reference is made.

Suitable gases for use in assisting the keeping qualities of the packaged goods in any of the embodiments herein are a combination of gases, or a single gas, including such atmospheric gases as Nitrogen, Carbon Dioxide and Oxygen. For red meats it is desirable to have 80% $O_2$, 20% $CO_2$ and that the volume of gas in spaces 9 equal the volume of the packaged meat.

It should be observed that at no time is the skin wrapping removed from the goods prior to use of the goods by a consumer. Thus the goods are hygenically wrapped up until this time. Such packaging not only presents the goods in a most appealing manner to the consumer but allows for the packaged goods to be stored for considerable periods of time and yet still be attractive and fresh looking.

Desirably all of the webs should be clear plastics material although this is not essential.

I claim:

1. A method of packaging goods including the steps of:

(a) providing a base, (b) placing goods over said base, (c) applying a flexible web of gas permeable skin wrapping plastics material over said base and said goods, (d) evacuating air or gas from between said base and said skin wrapping so as to allow said skin wrapping to flexibly displace onto said goods and to at least partially skin pack said goods relative to said base, (e) applying a lid over said skin wrapping and spaced therefrom, (f) providing a desired gas in said space between said lid and said skin wrapping to enhance the keeping properties of the packaged goods by permeating said skin wrapping, (g) sealing said lid to said base so that said space is permanently retained and attaching said skin wrapping relative to said base, and (h) following discoloration of the packaged goods with time, allowing a fresh gas which will improve the color of the goods to enter the package and contact the surface of the goods within said skin wrapping without removal of said skin wrapping.

2. A method as claimed in claim 1, wherein said lid is sealed to said base so that it can be peeled off said base while leaving said skin wrapping attached to said base, whereby when the color of the goods is to be improved, the lid can be peeled off to allow said gas to permeate said skin wrapping.

3. A method as claimed in claim 1, wherein said step of sealing comprises skin wrapping said web to said base around a peripheral lip of said base, and subsequently sealing said lid to said peripheral lip.

4. A method as claimed in claim 1, including the further step of forming at least one aperture through at least said lid whereby to allow said gas to enter said package to permeate said skin wrapping.

5. A method as claimed in claim 1, including the further step of forming at least one aperture through said lid whereby said gas can pass between said lid and said skin wrapping to directly contact said goods.

6. A method as claimed in claim 5, further including the step of sealing said at least one aperture following the passing of said gas.

7. A method as claimed in claim 3, further including the step of sealing said lid to said base and said skin wrapping to said base around an outer peripheral surface of said lip, forming at least one aperture in said lip internally of said outer peripheral surface, and sealing said formed aperture following the passing of said gas sealing inwardly of said formed aperture around an inner peripheral surface of said lip.

* * * * *